United States Patent [19]

Chen

[11] Patent Number: 4,999,747

[45] **Date of Patent: * Mar. 12, 1991**

[54] FLASH HAIR PIN

[76] Inventor: Jiann Shyong Chen, No. 25, Sublane 99, Lane 274, Cong-Cheng S. Rd., Yung-Kang Shiang, Tainan Hsien, Taiwan

[ * ] Notice: The portion of the term of this patent subsequent to Feb. 20, 2007 has been disclaimed.

[21] Appl. No.: 476,759

[22] Filed: Feb. 7, 1990

Related U.S. Application Data

[63] Continuation-in-part of Ser. No. 369,614, Jun. 21, 1989, Pat. No. 4,903,176.

[51] Int. Cl.[5] ..... F21L 1/00

[52] U.S. Cl. ..... 362/103; 362/105; 362/806; 63/3

[58] Field of Search ..... 362/103, 104, 105, 106, 362/801, 806; 63/3

[56] References Cited

U.S. PATENT DOCUMENTS 4,903,176 2/1990 Chen ..... 362/103

*Primary Examiner*—Ira S. Lazarus
*Assistant Examiner*—Sue Hagarman
*Attorney, Agent, or Firm*—Bacon & Thomas

[57] ABSTRACT

A fashionable hair pin having a series of running flash lights which comprises a curved body made of transparent or translucent material and having a channel grooved in an inner sidewall thereof for engaging a bulb belt having a plurality of flash bulbs of different colors controlled by an integrated circuit through a contact switch which is actuated to turn on or turn off the flash bulbs by means of a lip member formed in the curved body and a snap ring adapted to be engaged in the channel and positioned over the belt for holding the belt in place.

1 Claim, 3 Drawing Sheets

FLASH HAIR PIN

CROSS REFERENCE TO RELATED APPLICATION

This application is a continuation-in-part of Application Ser. No. 369,614 filed on Jun. 21, 1989 now U.S. Pat. No. 4,903,176.

BACKGROUND OF THE INVENTION

This invention relates to a hair pin and more particularly relates to a hair pin having a series of running flash lights.

A series of fashionable ornaments which are currently named as Disco Ornaments is designed and produced for teen-agers or even adults that facilitates creation of strong feeling or delightful atmosphere in a group activity such as dancing party. Those ornaments include necklace, emblem ring, bangle, coiffure, earring, brooch and so on. It is found that an ornament having sparkling or flash lights can promote said feeling or atmosphere in a dark field such as dancing hall.

SUMMARY OF THE INVENTION

It is accordingly a primary object of this invention to provide a fashionable hair pin having a series of running flash lights for ornamentation, making fun and enhancing delightful atmosphere.

According to the present invention, this and other objects are achieved by providing a flash hair pin which comprises a curved body made of transparent or translucent material and having a channel grooved in the inner sidewall for engaging a belt having a plurality of flash bulbs of different colors controlled by an integrated circuit through a contact switch which is actuated to turn on or turn off the flash blubs by means of a lip member formed in the curved body, and powered by batteries or cells, and a snap ring adapted to be engaged in the channel and positioned over the belt for holding the belt in place.

BRIEF DESCRIPTION OF THE DRAWINGS

In order that the present invention may be better understood, a preferred embodiment thereof will be described with reference to the accompanying drawings, in which.

DETAILED DESCRIPTION OF THE PREFERRED EMBODIMENT

Figure 1:
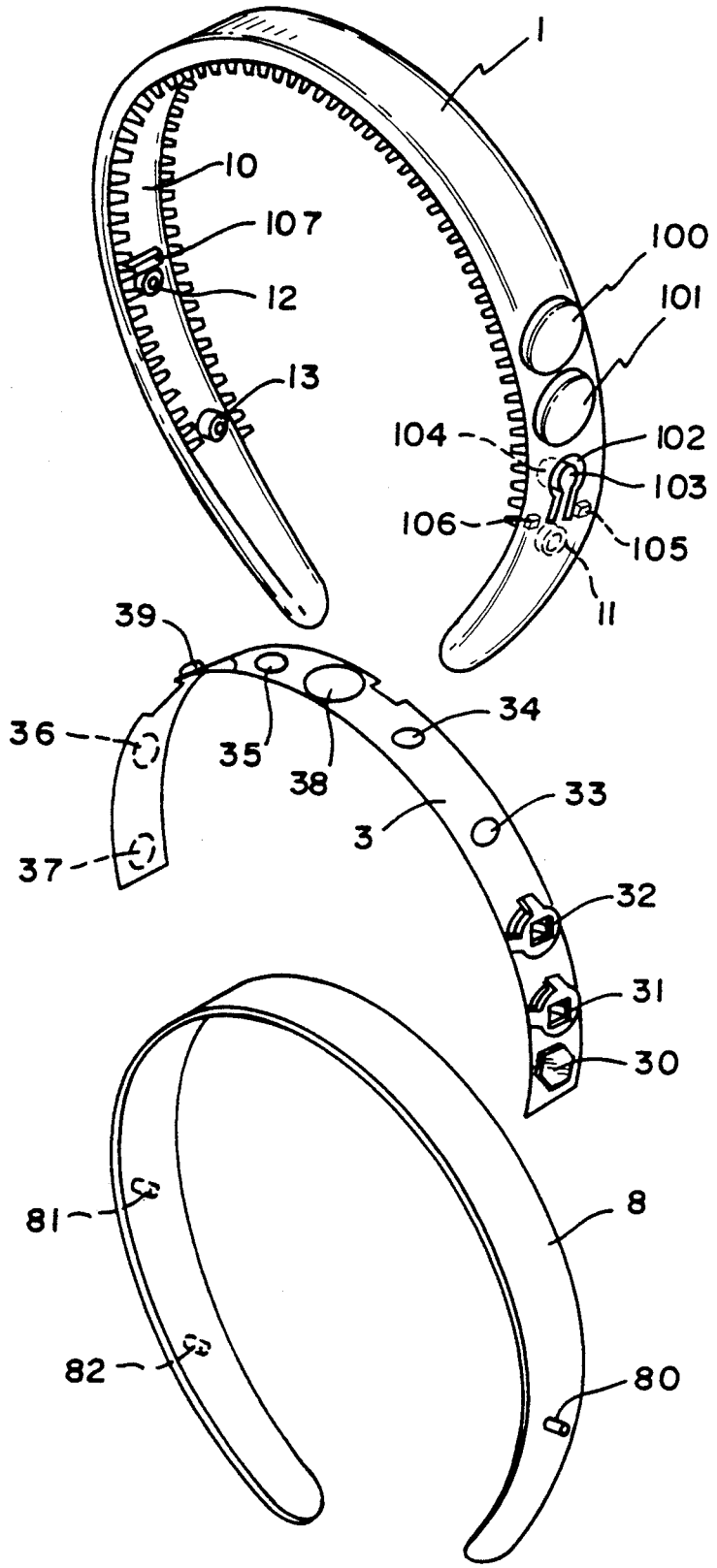
FIG. 1 is a perspective and exploded view of a preferred embodiment of a hair pin according to the present invention.

As shown in FIG. 1, a hair pin of this invention comprises a curved resilient body 1 made of transparent or translucent material, defining a passage which fits the hair portion of an wearer's head and grooved in the inner surface with a channel extending from end to end thereof; a bulb belt 3 adapted to be engaged in the channel 10 of the body 1; and a snap ring 8 adapted to be popped into the channel 10 for holding the bulb belt 3 in position in the channel 10.

One side of the body 1 is embossed with two projections 100, 101 thus forming two depressions in the opposite side in the channel 10 for accommodating batteries and is formed with a sharp-bent slots 102 next to the lower projection 101 and surrounding a resilient lip 103 also in the channel 10. A pair of lugs 105, 106 positioned at opposite side of the slot 102 and a cylindrical socket member 11 extending inwardly are formed in the channel 10 at one side of the body 1 and a lug 107 and two sapced cylindrical socket members 12, 13 extending inwardly are formed also in the channel 10 at the opposed side of the body 1. The head portion of the resilient lip 103 is provided with a pin 104 extending inwardly and being actuated by the resilient lip 103 to move between two positions.

An integrated circuit (normally and hereinafter named as IC) 38, a contact switch 30, two batteries 31, 32, a plurality of flash bulbs 33, 34, 35, 36 and 37 preferably of different colors such as red green and yellow, and a resistance 39 are evenly fitted in the bulb belt 3 which is made of deformable material and is adapted to be engaged in the channel 10 of the body 1 between the lug 107 and the lugs 105, 106 in a pair whereat the batteries 31, 32 are accommodated in the battery chambers defined in the projections 100, 101 and the contact switch 30, which is in a normally off state, locates in a position enabling access of the pin 104 of the lip 103.

The snap ring 8 is substantially in compliance with the body 1 in shape and formed with pins 80, 81, 82 extending outwardly on opposed sides thereof. As the snap ring 8 is popped into the channel 10 of the body 1, the pine 80, 81, 82 are correspondingly plugged into the socket members 11, 12, 13 for retaining the bulb belt 3 in position.

Figure 2:
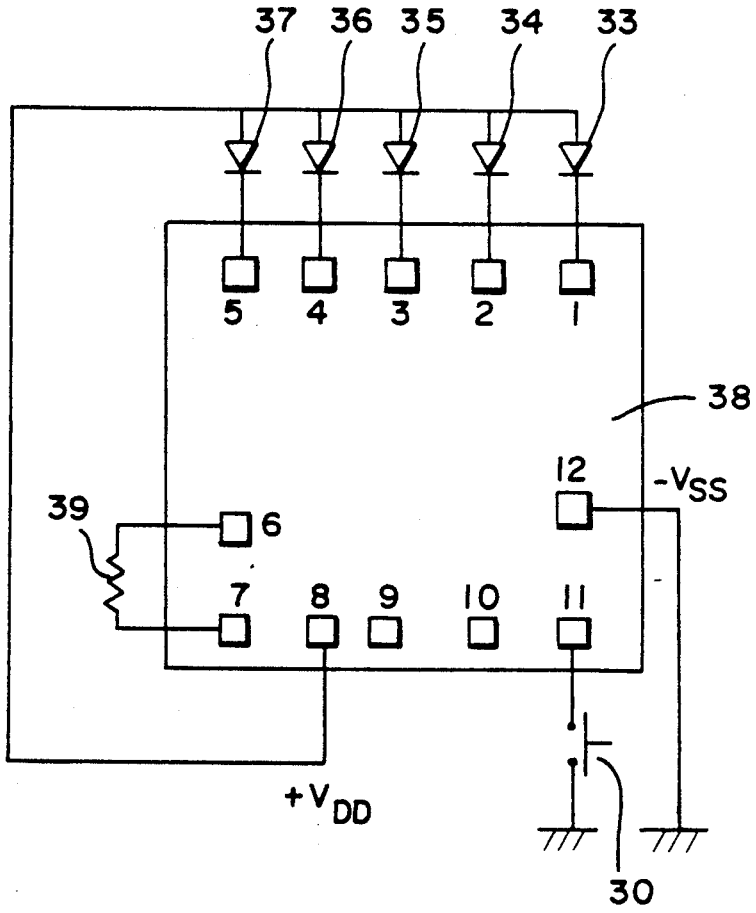
FIG. 2 is a control circuit used in the flash hair pin shown in FIG. 1.
Figure 3:
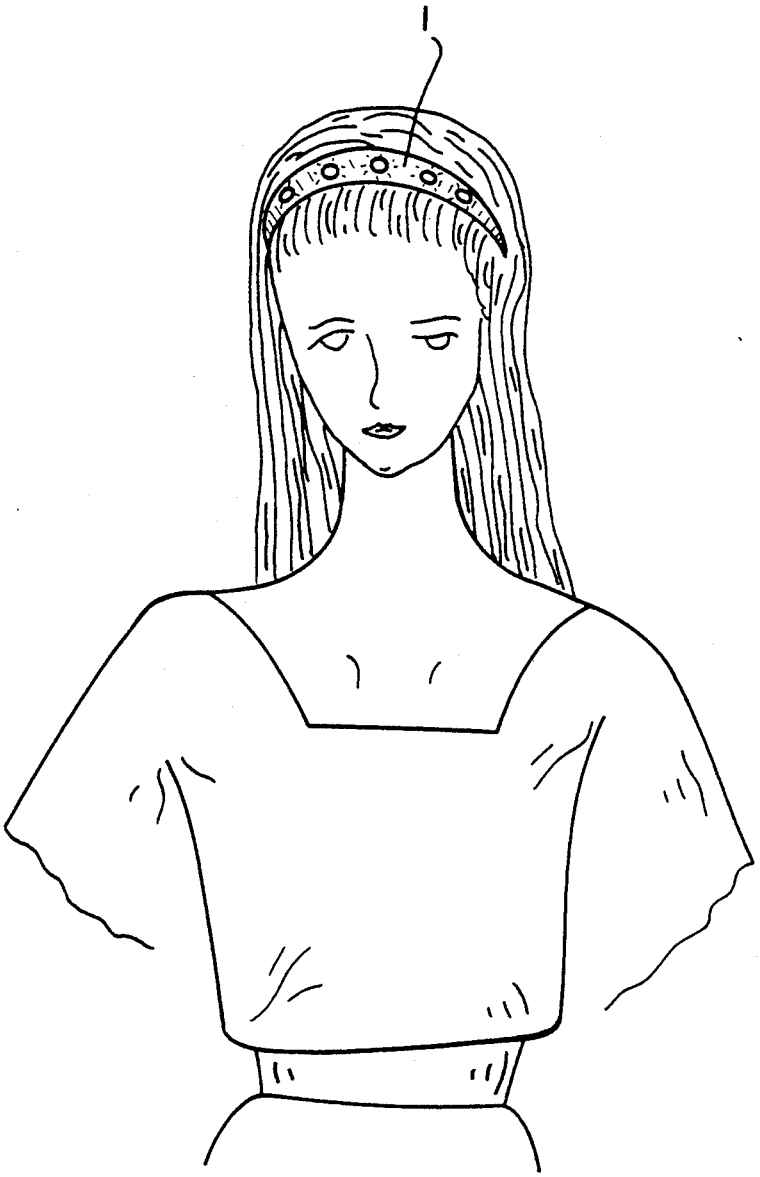
FIG. 3 is a schematic view of the hair pin in assembled condition, and showing the hair pin worn on a girl's head.

Referring to Fig. 2, the IC 38 used in this invention is identical with the IC 21 described in my U.S. application Ser. No. 369,614. Therefore, the description of the IC 38 herewith is omitted.

In operation, the flash hair pin of the present invention can be turned on by pushing the resilient lip 103 by which the pin 104 thereof is actuated to move from an OFF position into an ON position thus closing an energizing circuit powered by the batteries 31, 32 and running flash lights in the hair pin is performed and vice versa.

While the invention has been described with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structure.

What is claimed is:

1. A flash hair pin comprising:

a curved body made of resilient and translucent material, having a channel formed with at least a depression and a plurality of hollow projections or socket members having holes therein and extending inwardly, and an actuation member formed with a sharp-bent slot therein and adapted to swing inwards and outwards;

a bulb belt adapted to fit in the channel of the curved boy;

lug members formed within the channel for confining the bulb belt in the channel;

a plurality of flash bulbs evenly fitted in the belt and controlled by a circuit and powered by at least a battery accommodated in the depression in the curved body;

a switch connected in the integrated circuit for closing to energize the flash lights or open to distinguish the flash bulbs and mounted on the bulb belt at a position enabling access of the actuation member in the curved body to actuate the closing and open operations; and a snap ring adapted to be engaged in the channel and positioned over the bulb belt and having pins extending outwardly and adapted for plugging into holes of the projections or socket members within the channel.

* * * * *